US011452329B2

(12) United States Patent
Clough

(10) Patent No.: US 11,452,329 B2
(45) **Date of Patent: *Sep. 27, 2022**

(54) ORTHOPEDIC SHOE APPLIANCE

(71) Applicant: Cluffy, LLC, Polson, MT (US)

(72) Inventor: James Clough, Polson, MT (US)

(73) Assignee: Cluffy, LLC, Polson, MT (US)

( * ) Notice: Subject to any disclaimer, the term of this patent is extended or adjusted under 35 U.S.C. 154(b) by 210 days.

This patent is subject to a terminal disclaimer.

(21) Appl. No.: 16/702,805

(22) Filed: Dec. 4, 2019

(65) Prior Publication Data

US 2020/0100558 A1 Apr. 2, 2020

Related U.S. Application Data

(63) Continuation-in-part of application No. 14/862,757, filed on Sep. 23, 2015, now Pat. No. 10,506,843.

(51) Int. Cl.

| | |
|---|---|
| ***A43B 7/14*** | (2022.01) |
| ***A43B 17/00*** | (2006.01) |
| ***A43B 7/143*** | (2022.01) |
| ***A43B 7/1445*** | (2022.01) |
| ***A43B 7/149*** | (2022.01) |
| ***A43B 7/142*** | (2022.01) |

(52) U.S. Cl.

CPC ..... *A43B 7/143* (2013.01); *A43B 7/142* (2013.01); *A43B 7/149* (2013.01); *A43B 7/1445* (2013.01); *A43B 17/00* (2013.01)

(58) Field of Classification Search

CPC ..... A43B 7/14; A43B 7/1405; A43B 7/141; A43B 7/142; A43B 7/143; A43B 7/1445; A43B 7/149; A43B 17/00

USPC ..... 36/71, 91, 140, 145, 166

See application file for complete search history.

(56) References Cited

U.S. PATENT DOCUMENTS

| | | | | |
|---|---|---|---|---|
| 1,845,681 | A * | 2/1932 | Read | A43B 7/1445 36/147 |
| 1,992,081 | A * | 2/1935 | Madinger | A43B 7/1435 36/178 |
| 2,089,384 | A * | 8/1937 | Levitt | A43B 7/1445 36/145 |
| 2,161,565 | A | 6/1939 | Severino | |
| 3,265,071 | A | 8/1966 | Kirchner | |
| 4,224,750 | A * | 9/1980 | Delport | A43B 7/144 36/128 |
| 4,333,472 | A | 6/1982 | Tager | |
| 4,813,159 | A | 3/1989 | Weiss | |
| 5,388,351 | A * | 2/1995 | Mitchell | A43B 7/142 36/145 |

(Continued)

*Primary Examiner* — Sharon M Prange

(74) *Attorney, Agent, or Firm* — Osha Bergman Watanabe & Burton LLP

(57) ABSTRACT

An orthopedic shoe appliance includes a pad for providing support for midfoot arches, the second metatarsal, and the third metatarsal of a foot, wherein the pad does not provide substantial support under a heel of the foot or under the first metatarsal, the fourth metatarsal, and the fifth metatarsal. A method for manufacturing an orthopedic appliance includes obtaining a pad; and shaping the pad to provide support for midfoot arches, the second metatarsal, and the third metatarsal of a foot, but not provide substantial support under a heel of the foot or under the first metatarsal, the fourth metatarsal, and the fifth metatarsal.

16 Claims, 4 Drawing Sheets

(56) References Cited

U.S. PATENT DOCUMENTS

| | | | | |
|---|---|---|---|---|
| 6,141,890 | A * | 11/2000 | Chtn | A43B 3/12 36/141 |
| 6,170,176 | B1 | 1/2001 | Clough | |
| 6,725,578 | B2 | 4/2004 | Kerrigan | |
| 6,874,258 | B2 | 4/2005 | Clough et al. | |
| 6,938,363 | B1 | 9/2005 | Clough | |
| 8,240,066 | B2 | 8/2012 | Logan | |
| 9,439,810 | B2 | 9/2016 | Stilwell | |
| 2002/0014024 | A1 * | 2/2002 | Gardiner | A43B 7/146 36/155 |
| 2006/0242860 | A1 | 11/2006 | Canvin | |
| 2010/0263232 | A1 | 10/2010 | Smirman | |
| 2011/0099842 | A1 * | 5/2011 | Burke | A43B 7/1465 36/44 |
| 2015/0359682 | A1 * | 12/2015 | Stilwell | A43B 7/142 602/66 |

* cited by examiner

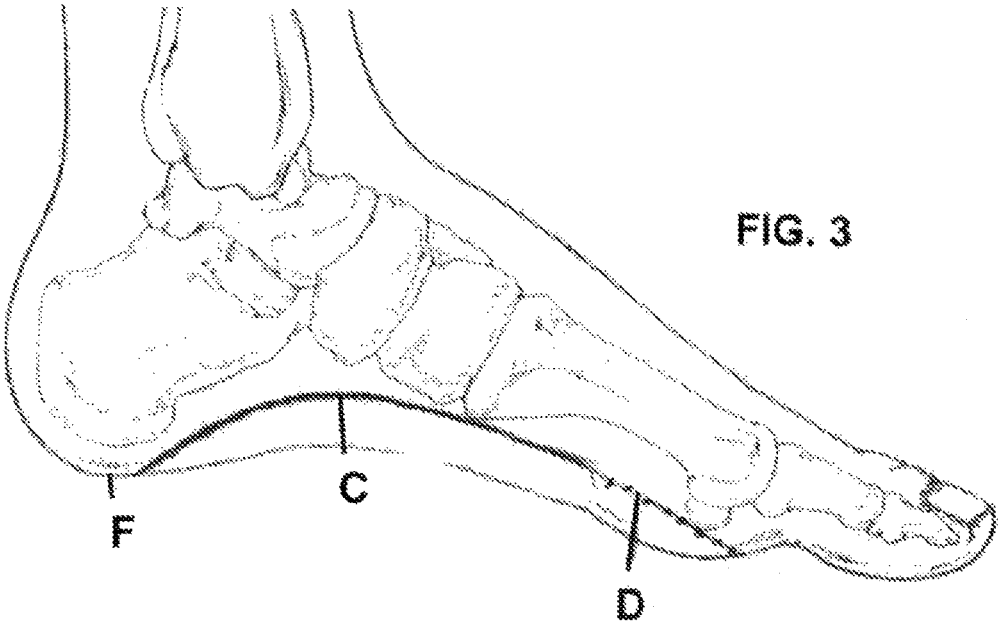
FIG. 3
FIG. 4
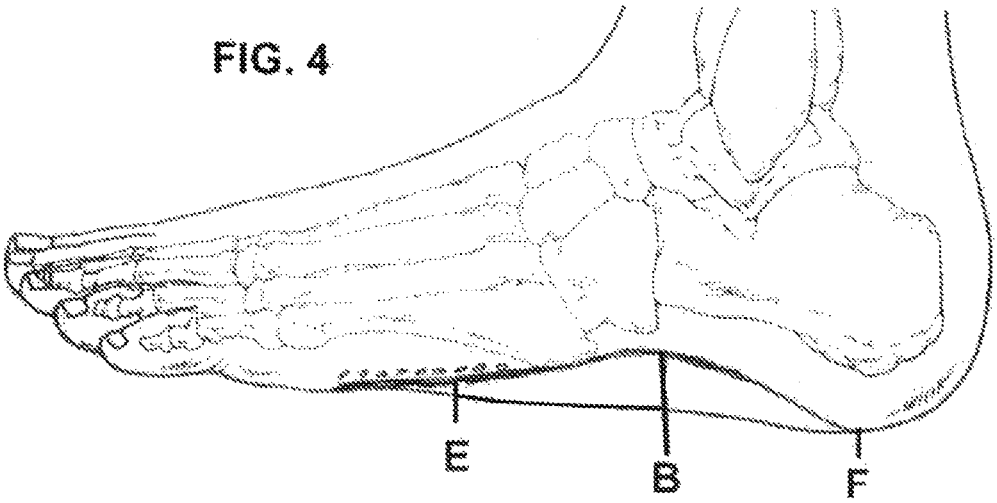

ORTHOPEDIC SHOE APPLIANCE

CROSS-REFERENCE TO RELATED APPLICATION

The present application is a continuation-in-part of U.S. patent application Ser. No. 14/862,757, filed on Sep. 23, 2015, which is herein incorporated by reference in its entirety.

BACKGROUND

Field

The present disclosure relates to orthopedic shoe appliances specifically adapted to supporting those segments of the foot requiring stability and allowing other segments to move freely that are meant to move as the foot moves through its phases of gait.

Description of Related Art

When a person ambulates, the foot is required to serve two essential roles. As the heel contact the ground, the foot functions as a mobile adapter to the terrain and as a shock absorber. This is commonly referred to as pronation. As the foot moves forward, the big toe moves upward, in coordination with the forward movement of the opposite arm, to help the foot to become much more stable through the windlass mechanism that causes the bone structure to assume a much more closely packed position, thereby enhancing the stability of the foot. This is commonly referred to as supination. This change of the foot bone structure is necessary as the foot serves two essentially opposite roles in the course of ambulation.

Improper foot structure may cause pain in the foot or inefficient ambulation. To correct such defects and alleviate pains, many orthopedic devices (orthopedic appliances) have been developed. These orthopedic appliances may be designed to correct specific types of foot problems.

For example, U.S. Pat. No. 4,813,159, issued to Weiss, discloses an insole having an extension under the first and fifth toes and a heel post to correct for an inverted heel. The device provides for added correction in these areas to control malposition of the foot.

U.S. Pat. No. 4,224,750, issued to Delport, discloses an insole applied to footwear that has various support features and goes from the heel to the metatarsals. It supports the entire foot and does not contain any areas where there is no material under the foot from the metatarsals to the heel.

U.S. Pat. No. 4,333,472, issued to Tager, discloses a compensatory corrective orthopedic foot device comprising a series of differentially sized, geometrically shaped, and specifically configured, generally wedge-shaped prosthetic devices that are used in compensatory treatments of specific clinical structural abnormalities of a human foot.

U.S. Patent Application Publication No. 2006/0242860, by Canvin, discloses an insole as part of a footwear that comprises a metatarsal insert and a combined heel and arch insert. This is a full length insole with different materials having differing durometers to accommodate different support areas targeted by this insole.

While the above identified prior art devices are useful for correcting various foot problems, there is still a need for orthopedic appliances that can provide further correction of foot defects

SUMMARY

Embodiments of the present disclosure relate to orthopedic appliances (or orthopedic shoe appliances) and methods for manufacturing the orthopedic appliances. Orthopedic appliances of the disclosure may provide improved functions of the human foot, by selectively stabilizing certain segments (areas) of a foot, while allowing other segments (areas) of a foot to move freely. This selective stabilization may be accomplished by having an orthopedic appliance for placement under the foot in the selected areas. The orthopedic appliances may have different heights and/or different material properties (e.g., durometers) at different locations. In addition, orthopedic appliances of the disclosure are designed to have no support in areas (e.g., under the heel) that need more free movements, in order to promote normal gait and better interface with footwear.

In accordance with embodiments of the disclosure, the unique combination of having supports in selected areas and lacking support in other areas leads to physiologic promotion of more normal motion in certain locations of the foot, such as the first, fourth, and fifth rays, while restricting unnecessary motion in other areas, such as the mid-foot and midtarsal joints and, therefore, the subtalar joint. The unique combination of having supports under selected areas of a foot and lacking supports under other areas of a foot, achieve a synergistic effect in the effectiveness of correcting abnormal foot function.

The physiologic and unique characteristics of an orthopedic appliance of the disclosure may be designed with footwear in mind. It may be designed to complement or enhance integration of the current devices with footwear, for optimal foot control and reduction of physical symptoms associated with ambulatory mechanical disorders. There are many deformities and pains that may be prevented by the use of a product of the present disclosure, including bunion, hammertoes, neuromas bunionettes, Achilles tendon disorders, postural pains, heel pain, metatarsal pain, stress fracture, arch fatigue and tendonitis, when used in conjunction with a program of promoting normal gait.

An orthopedic appliance of the disclosure can be used with a foot, inserted into a sock or use with footwear (e.g., a shoe or sandal). Alternatively, an orthopedic appliance of the disclosure may be built into an insole, a midsole or an outsole of a shoe or other footwear. That is, an orthopedic appliance of the disclosure may be formed as an integral piece with an insole, a midsole, an outsole, or a footwear. Such an orthopedic appliance may be made of any suitable material commonly used for such purposes, such as a gel material, foam, thermoplastics, leather, cork, fiber, or various combinations of materials.

An orthopedic appliance of the disclosure can provide support for the midfoot arches (i.e., the lateral longitudinal arch, the medial longitudinal arch, and the transverse metatarsal arch), while it provides no support under the heel and/or the distal ends of the first, fourth, and fifth metatarsals.

In accordance with some embodiments of the disclosure, an orthopedic appliance of the disclosure may comprise a substantially triangular-shaped piece to provide midfoot arch supports (i.e., the medial longitudinal arch support, the lateral longitudinal arch support, and the transverse metatarsal arch support). Such an orthopedic appliance may be of varying heights to support selected segments of the foot needing more stability in the select areas, while motion is promoted in other areas that need to move freely for normal foot function.

In accordance with some embodiments of the disclosure, an orthopedic appliance may be disposed in footwear and is to be worn for improved function of the foot structures during ambulation. An orthopedic appliance of the disclosure may be attached to an insole, midsole or outsole by any means known in the art. For example, an orthopedic appliance of the disclosure may be attached to an insole, midsole, or outsole via Velcro® (i.e., a loop-and-hook mechanism), adhesive, glue, a strap, etc. In addition, an insole, midsole, or outsole may be provided with holes and an orthopedic appliance of the disclosure may be provided with matching pegs (protrusions) and an orthopedic appliance of the disclosure may be provided with matching holes that can accommodate the matching pegs.

Alternatively, an orthopedic appliance of the disclosure may be formed as an integral piece of an insole, a midsole, an outsole, or a footwear (e.g., a shoe, a sandal, etc.). Alternatively, such an orthopedic appliance may be used with a sock, either by attaching to inside or outside of a sock, or be integrated with a sock.

In accordance with some embodiments of the present disclosure, an orthopedic appliance may be applied to a human foot. For example, such an orthopedic appliance may include a mechanism (e.g., a strap, an elastic band, Velcro, etc.) for attachment to the foot.

A method in accordance with embodiments of the disclosure may comprise using an orthopedic appliance of the disclosure, such as a substantially triangular-shaped piece described above, to support the segments of the foot needing more stability in select areas of the foot. At the same time, motion is promoted in other segments that need to move freely for normal foot function. To promote movements in such areas, an orthopedic appliance of the disclosure may be designed to have no material in these areas (e.g., under the heel or first, fourth, and fifth metatarsals) such that more normal physiologic foot function can occur.

In accordance with some embodiments of the disclosure, a method for manufacturing an orthopedic appliance, comprising: providing a pad; and shaping the pad to provide support for midfoot arches, the second metatarsal, and the third metatarsal of a foot, but not under a heel of the foot or under the first metatarsal, the fourth metatarsal, and the fifth metatarsal.

In accordance with embodiments of the present disclosure, an orthopedic appliance is easy to manufacture and of sturdy construction to allow for long-term use.

In accordance with embodiments of the present disclosure, an orthopedic shoe appliance may allow for a combination of stability in certain areas and freedom of motion in other areas in a unique and optimal physiologic manner.

Embodiments of the disclosure are achieved by orthopedic shoe appliances and methods specifically designed to provide for improved functions of the foot structure during ambulation.

Further aspects of the present disclosure will become apparent from the following description references being had to the accompanying drawings wherein a preferred form of the embodiment of the current disclosure is clearly shown.

BRIEF DESCRIPTION OF THE DRAWINGS

FIG. 3 shows a side view of the medial side of a foot showing the contour of an orthopedic appliance of the disclosure fit to the medial arch of the foot.

FIG. 4 shows a side view of the lateral side of a foot illustrating the contour of an orthopedic appliance of the disclosure fit to the lateral arch of the foot.

DETAILED DESCRIPTION

Embodiments of the disclosure relate to orthopedic appliances that have supports under selected locations of a foot, while lack of supports under other areas of the foot. Some embodiments of the disclosure relate to methods for supporting a foot using an orthopedic appliance of the disclosure such that certain areas of a foot is provided with supports, while other areas lack supports, during ambulation.

Figure 1:
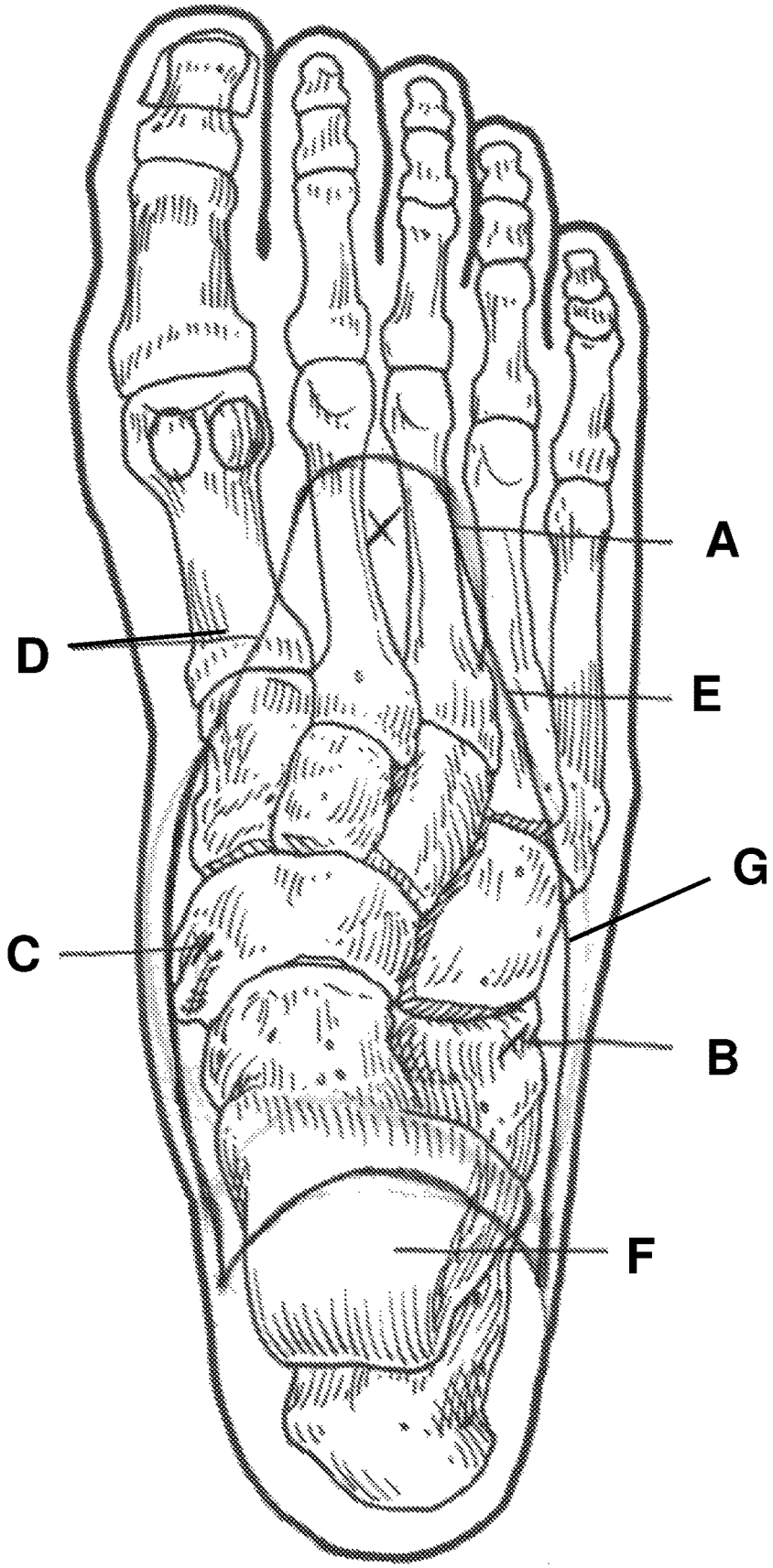
FIG. 1 shows an illustration of an orthopedic appliance in accordance with an embodiment of the disclosure showing the locations where the orthopedic appliance sits in relation to the bone structure of a human foot.

As used herein, the terms "orthopedic appliance" and "orthopedic shoe appliance" may be used interchangeably and each refers to a pad (or a device) having different heights and/or durometers in different regions of the pad to provide different extents of support to a foot. In accordance with embodiments of the disclosure, an orthopedic appliance may also be designed to be devoid of support (or no substantial support) under certain areas (e.g., the first, fourth, and fifth metatarsals) of a foot. As used herein, "no substantial support" under certain areas means that the pad does not reach under certain areas or only reaches under these areas slightly. For examples, a pad that does not provide substantial support to the first, fourth, and fifth metatarsals may reach under a portion of the proximate ends of these metatarsals, but would not reach under the middle or distal ends of these metatarsals, as illustrated in FIG. 1.

Such an orthopedic appliance may be used under a foot to support selected areas of the bone structures of a foot, while not providing substantial support under other areas of the foot to allow these other areas to flex more. Furthermore, the support at the selected areas will function as a cantilever to further facilitate movements of these other areas that are not supported, thereby achieving synergistic effects.

As used herein, the term "midfoot arches" refers to the medial longitudinal arch, the lateral longitudinal arch, and the transverse metatarsal arch. As used herein, the term "footwear" refers to a shoe, a sandal, a slipper, a boot, or the like.

Materials for use with embodiments of the disclosure may include any suitable materials known in the art for making footwear or footwear accessories. Such materials, for example, may include plastic, rubber, elastomer, foam, cork, wood, metal, alloy, fiber etc. or a combination thereof. An orthopedic appliance of the disclosure may use different heights in different regions and/or different durometers (e.g., different materials) in different regions to provide different extents of support in different areas under a foot. In addition, a proper height or durometer in a particular region may be designed based on an average foot of certain sizes or may be designed for a particular individual (i.e., custom fit). Based on teachings in this disclosure and common knowledge known in the art, one skilled in the art would be able to design and manufacture such orthopedic appliances without undue experimentation.

Embodiments of the disclosure are based on the observation that there are joints of the foot that serve as stabilizers, where little motion occurs. On the other hand, there are other segments that undergo more significant changes (mobile adapters), depending on the positions of the foot in the instep of the foot, commonly referred to as Lisfrancs' joint in the medical literature.

For example, the first metatarsal cuneiform joint is a relatively mobile segment allowing the first metatarsal to move upward as the foot contacts the floor and move downward as the big toe moves upward. In contrast, the second and third metatarsal cuneiform joints are very stable due to the shape of the bone and the strong ligamentous structure. These are not meant to move that much and, therefore, do provide inherent stability to the foot structure.

The fourth and fifth metatarsal cuboid joints are mobile adapters and serve to cushion the strike of the forefoot on the ground, particularly with certain athletic activities, in which the outside of the foot contacts the ground initially.

Providing support to the midfoot arches also allows for a better control of excessive deleterious motion of the metatarsals 1, 4, and 5 upward. The supports for the midfoot arches can be accomplished medially with a medial longitudinal arch support and laterally with a lateral longitudinal arch support. In addition, support can be provided to the transverse metatarsal arch. The principle of support in the mid foot location is to cantilever the metatarsal heads downward by applying an upward force on the base (proximal end) of the metatarsals, thereby preventing excessive upward movements of the distal ends of the metatarsals.

Accordingly, orthopedic appliances of the disclosure are designed to support the midfoot arches and under the second and third metatarsals. However, these orthopedic appliances preferably would not have substantial supports under the first, fourth, and fifth metatarsals, at least not supporting the distal ends of the first, fourth, and fifth metatarsals. In accordance with some embodiments, orthopedic appliances of the disclosure may reach a small parts of the proximal ends of the first, fourth and fifth metatarsals, but not to the middle or distal ends of these metatarsals.

The heel of a foot is not easily controlled by placing a material under or around the heel, and any such control may result in problems with poor fit in most footwear and result in reduced comfort in many individuals.

Orthopedic appliances of the present disclosure substantially do not have support materials under the first, fourth and fifth metatarsals to allow these segments to move downward, but have support materials under the medial lateral and transverse metatarsal arches to provide supports for these arches. Supporting the midfoot arches actually allows for control of the excessive deleterious upward motions of metatarsals 1, 4, and 5. The midfoot support can be accomplished medially with a medial longitudinal arch support and laterally with a lateral longitudinal arch support. Thus, the pad of the present disclosure may include a medial raised contour that is configured to be disposed under a medial arch and a lateral raised contour configured to be disposed under a lateral portion of the foot and the cuboid, such that the medial raised contour is higher than the lateral raised contour. In particular, in one or more embodiments, the lateral raised contour may be at a height ranging from 3 to 9 mm, particularly 6-8 mm, and the medial raised contour may be at a height ranging from 5 to 15 mm, particularly 10-13 mm.

The principle of supports at these locations is to cantilever the metatarsal heads downward by applying an upward force on the base of the metatarsals. In addition, an orthopedic appliance of the disclosure also provides support under the second and third metatarsals. The second and third metatarsals are not involved in significant movements during ambulation. Therefore, support under the second and third metatarsals would increase the stability of a foot. Furthermore, in accordance with embodiments of the disclosure, an orthopedic appliance has is no support material under the heel to allow for better comfort and fit of the orthopedic appliance in footwear.

Conventional orthopedic corrective devices for controlling excessive pronation and supination do not allow the mobile metatarsal segments 1, 4 and 5, to move downward because the support materials are applied under these bones distally (i.e., under the distal ends of the metatarsals). This is a hindrance to normal foot functions and can result in a non-physiologic and restricted motion of the foot structure. Removal of material under the heel allows better comfort and fit of the device in footwear, while promoting better rocking of the foot forward during the step.

One or more embodiments of the present disclosure relate specifically to orthopedic corrective devices that may be disposed in a footwear and applied to the correction and treatment of ambulatory mechanical disorders and ensuing physical symptoms. However, one or more other embodiments relate to footwear that integrates such an orthopedic corrective device therein.

Embodiments of the disclosure will be further explained with references to the accompanied drawings. The specific examples described are for illustration only. One skilled in the art would appreciate that other modifications and variations from these specific examples are possible without departing from the scope of the disclosure.

Referring to FIG. 1, which shows an orthopedic shoe appliance (G) applied over a diagram of the skeleton of the human foot. Point (A) shows the distal aspect of the orthopedic appliance proximal to the second and third metatarsals, and with a raise in this area under the transverse metatarsal arch. Point (B) is located at the lateral longitudinal arch, of which the highest point is at the calcaneal-cuboid joint. Point (C) is located at the highest point of the medial longitudinal arch around the point of the tarsal navicular bone.

Point (D) shows the first metatarsal is not substantially supported by the orthopedic appliance (G)—i.e., the orthopedic appliance does not reach under the center and distal portion of the first metatarsal. This is to allow the first metatarsal to plantarflex during propulsion in the normal gait cycle as the hallux dorsiflexes. The Point (C) acts as a cantilever to plantarflex metatarsal 1. This eliminates any deformity of the forefoot referred to as forefoot supination or forefoot varus. Any material under the first metatarsal may potentially limit the ability of the first metatarsal to plantarflex. Therefore, an orthopedic appliance of the disclosure is designed to have no support material under the first metatarsal.

Point (E) shows that the orthopedic appliance (G) substantially does not go under the fourth and fifth metatarsals to allow these bones to plantarflex in propulsion, so that point (B) may act to cantilever the fourth and fifth metatarsals in a downward manner. This eliminates any deformity referred to as forefoot valgus.

In addition, Point (F) shows that the orthopedic appliance (G) does not go under the heel. This is to allow the heel to sit in the shoe for a better fit and comfort. Control of the heel is facilitated by point (B) to support the calcaneus in an elevated position and point (C) to support the talar head and medial longitudinal arch.

Figure 2:
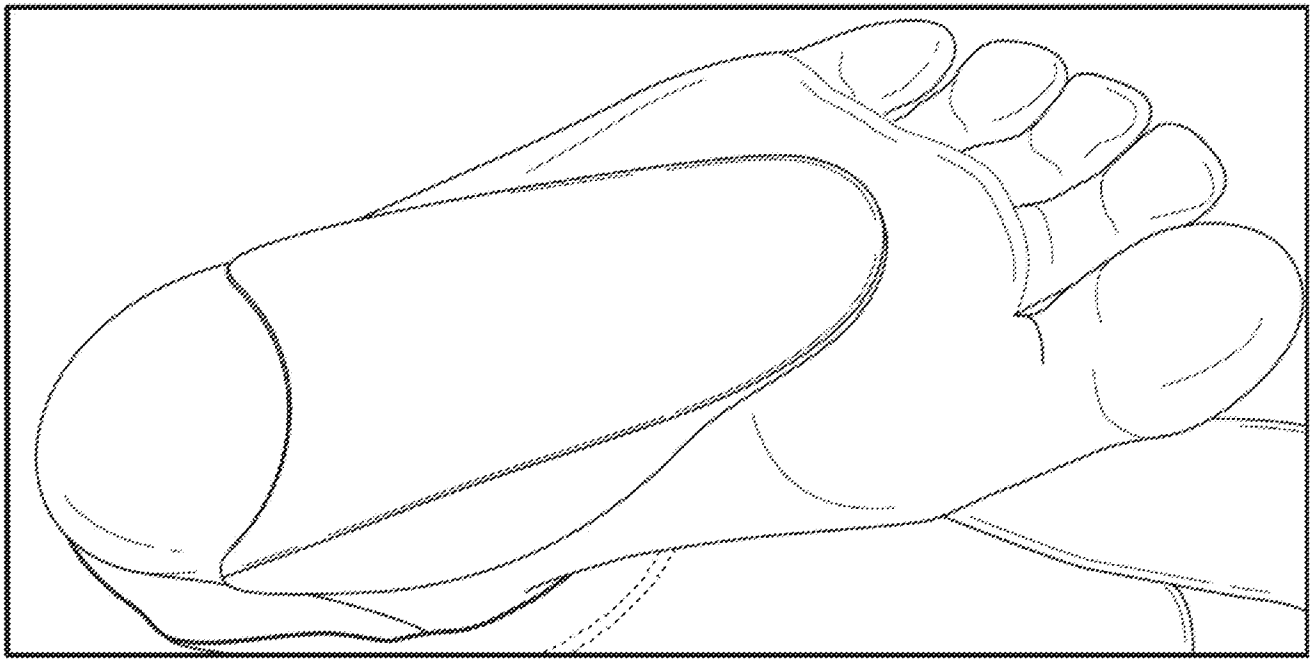
FIG. 2 shows an illustration of an orthopedic appliance in accordance with an embodiment of the disclosure showing the locations where the orthopedic appliance sits in relation to the form of a human foot.

Therefore, an orthopedic appliance of the disclosure is designed to have no contoured support material under the first metatarsal, the fourth metatarsal and the fifth metatarsal, as well as no contoured support under the heel. However, orthopedic appliances of the disclosure are designed to have support materials under the second and the third metatarsals, as well as under the midfoot arches, as shown in FIG. 2, which shows a perspective view of an orthopedic appliance in accordance with one embodiment of the disclosure placed on a foot.

FIG. 3 shows a side view of the medial aspect of a human foot. Point (F) shows that an orthopedic appliance of the disclosure does not go under the heel of the foot. Point (C) shows that the height of the arch on the medial side of the device is located at the tarsal navicular bone. Point (D) (dotted line) shows that an orthopedic appliance of the disclosure substantially does not extend under the first metatarsal (not under the distal end of the first metatarsal; see FIG. 1), but extends under the second and third metatarsals.

FIG. 4 shows a lateral perspective of a human foot. Point (F) shows that the correction of the orthopedic appliance of the disclosure does not extend under the heel of the foot. Point (B) shows the highest point of the lateral arch is at the calcaneal-cuboid joint. Point (E) (dotted line) shows that an orthopedic appliance of the disclosure substantially does not extend under the fourth and fifth metatarsals (i.e., does not reach under the distal ends of the fourth and fifth metatarsals; see FIG. 1). However, an orthopedic appliance of the disclosure does extend under the second and third metatarsals (see FIG. 1).

In accordance with embodiments of the disclosure, lack of support under the first metatarsal, fourth metatarsal, and fifth metatarsal, coupled with support under midfoot arches (e.g., points (B) and (C) shown in FIG. 3 and FIG. 4), provides proper support to a foot and permits the metatarsals to have downward movement to correct for any forefoot supination or forefoot valgus. These combined features are unique for the orthopedic appliances of the disclosure. It is also noteworthy that the lack of material under the heel is unique and allows for better comfort for the user and better fit in footwear. It has been found that materials under the heel are ineffective at controlling pronation and supination of the heel. In accordance with embodiments of the disclosure, the lack of correction under the heel allows the heel to function as intended, i.e., to roll forward for the next step. The lack of correction under the heel of the current application allows the use of flat materials under the heel in conjunction with the current pad, to elevate the heel to a desired height and the use of soft materials, such as polyurethane or silicone gels and various foams or natural materials, to assist in the shock absorption often desired, particularly when constructing an insole addressing heel pain, where shock absorption is an important element of an effective insole for this condition.

Embodiments of the disclosure may have one or more of the following advantages. Orthopedic appliances of the disclosure are designed to support selected areas under a foot, instead of supporting all areas of the foot because not all areas under the foot need equal amounts of support. The selected areas for support include midfoot arches and under the second and third metatarsals. These segments in a bone structure of a foot move less during ambulation and would benefit from more support. Limiting motion in these segments would promote, via cantilever action, motions in other joints that require more movement during ambulation.

In a bone structure of a foot, certain segments are required to be more mobile than others during ambulation. These mobile segments require more freedom to move and therefore would benefit from less support (relative to other areas) for normal functions of a foot. Therefore, orthopedic appliances of the disclosure may be specifically designed to be devoid of support under these segments.

Providing support under segments that require less movement can also function as a cantilever to facilitate segments that need to move more. Therefore, a combination of providing support under the selected regions and not providing support under other regions can achieve synergistic effects, allowing more effective correction of any ambulatory problems of a foot.

The orthopedic appliances of the disclosure may be attached to an insole, midsole, or outsole of a shoe. Alternatively, these orthopedic appliances may be designed to be an integral part of an insole, midsole, outsole, or a footwear. In embodiments incorporating the orthopedic appliance of the disclosure into an insole, a midsole, an outsole, or a footwear, it may be envisioned that the pad may be configured to provide support to the distal ends of the particular metatarsals and arches, as described above, and not to the other metatarsals or heel. In such embodiments, it may be recognized that in the above described articles, the "lack of support" of the first, fourth, and/or fifth metatarsals and the heel may in fact refer to a difference in height using these locations as a baseline for measurement. In such embodiments, the height of the arches can be determined and are at least 1 mm higher than the locations under the distal ends of the first, fourth, and/or firth metatarsals and/or the heel, or the durometer of material first, fourth, and/or firth metatarsals and/or the heel may be softer, and/or lack contour. Alternatively, the heel pad can be constructed of different materials for shock absorption such as gels, foams or natural materials, and when the foot bears weight on the heel pad, the heel is at least 1 mm lower than the arches.

Other features may incorporate different materials that may deform more or less in different areas of the shoe to support the correction of the pad desired for the user. Less deformable materials can be used on the outside arch for those that tend to roll their foot too much to the outside. Alternatively more dense materials can be used on the inside arch (medial) for those that tend to roll to the inside of the shoe too much. The density of the material can be used with the current pad to improve the functionality of the pad by making these shoe modifications.

Figure 5:
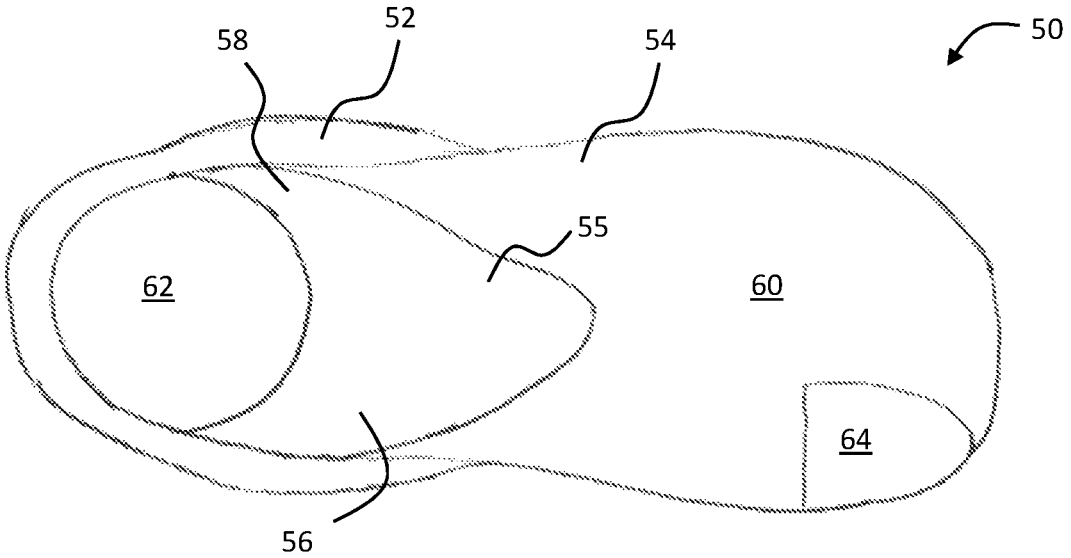
FIG. 5 shows a top view of a sole in accordance with one or more embodiments
Figure 6:
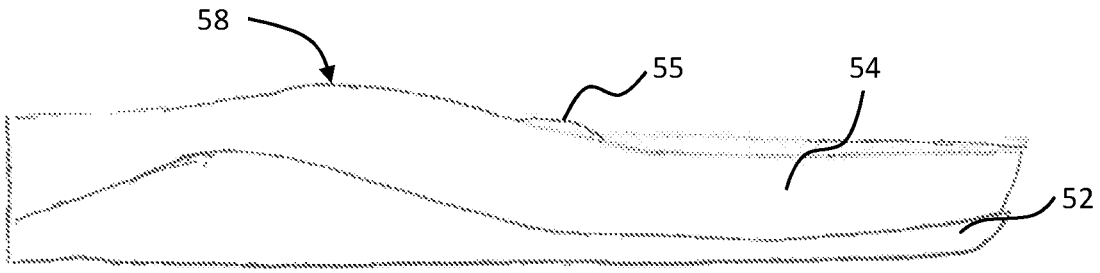
FIG. 6 shows a lateral side view of the sole of FIG. 5
Figure 7:
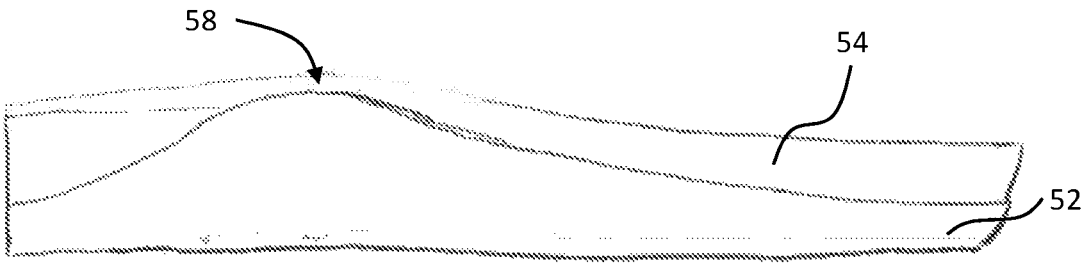
FIG. 7 shows a medial side view of the sole of FIG. 5.

The insole, midsole or outer sole of footwear can be extended under the pad on the medial or lateral side of the foot to augment the correction of the insole, and provide for better support of the pad on the foot. For example, referring to FIGS. 5-7, a top view, lateral side view, and medial side view of a shoe sole for footwear are respectively shown. As shown, the sole 50 includes an outer sole 52 and a mid sole 54. While an insole is not specifically shown, it is understood that an insole may also be included, and in one or more embodiments, depending on the anatomy of the footwear, the features shown as being on the midsole may be present on another part of the shoe, such as the insole. The midsole 54 may include a pad 55 that provides support to the midfoot arches, as described above, including support to the distal ends of the second and third metatarsals (without supporting the distal ends of the first, fourth, and fifth metatarsals). Thus, the pad 54 of the present disclosure may include a medial raised contour 56 that is configured to be disposed under a medial arch and a lateral raised contour 58 configured to be disposed under a lateral portion of the foot and the cuboid, such that the medial raised contour is higher than the lateral raised contour. In particular, in one or more embodiments, the lateral raised contour 58 may be at a height ranging from 3 to 9 mm, particularly 6-8 mm, and the medial raised contour 56 may be at a height ranging from 5 to 15 mm, particularly 10-13 mm. Such contours 56, 58 are envisioned as extending to the to the outermost bounds of midsole 54. Further, in order to provide structural integrity to the sole (and shoe as footwear as a whole), outer sole 52 is wider than the midsole 54 in in the regions corresponding to the contours 56, 58, as compared to the forefront 60 of the sole 50. In addition to extending wider than midsole 54, the outer sole 52 also extends higher in the regions corresponding to the contours 56, 58. As shown, the outersole 52 is higher at the medial contour 56 than at the lateral contour 58; however, it is also envisioned that the sides may have the same height, which has a peak height that extends, for example, as high as the midsole 54. Further, as shown in FIG. 5, the heel 62 of the midsole may include a material of a different durometer or density, or be of a different height, relative to pad 55. Additionally, as shown there may optionally be an inclined support 64 at a location corresponding to the big toe.

In addition, these orthopedic appliances may be attached to inside or outside of a sock, or formed as an integral part of a sock. These orthopedic appliances may be used together with other orthopedic devices, such as an Cluffy Wedge®, as disclosed in U.S. Pat. Nos. 6,170,176, 6,874,258, and 6,938, 363, issued to the inventor of the present disclosure.

While the disclosure has been described with a limited number of examples, those skilled in the art, having the benefit of this disclosure, would appreciate that other modifications and variations are possible without departing from the scope of the disclosure. Accordingly, the scope of the disclosure should be limited only by the attached claims.

What is claimed is:

1. An orthopedic shoe appliance, comprising:

a pad for providing support for midfoot arches, the second metatarsal, and the third metatarsal of a foot, wherein the pad is configured to not provide support under a heel of the foot, wherein the pad comprises a first portion configured to provide support to the midfoot arches, and a second portion that extends distally from a region corresponding to proximal ends of the second and third metatarsals to form an elongate extension that supports the second and third metatarsals and such that the pad is configured to not fully support proximal ends of any of the first metatarsal, the fourth metatarsal, and the fifth metatarsal, wherein the first portion comprises a medial raised contour configured to be disposed under and support a medial arch and a lateral raised contour configured to be disposed under and support a lateral longitudinal arch and entire calcaneal-cuboid joint, such that the medial raised contour is higher than the lateral raised contour, wherein a width of the second portion is smaller than a width of the first portion, and wherein the distal end is narrower than a proximal end of the orthopedic shoe appliance, and the second portion, moving away from the distal end, widens generally continuously to reach the lateral raised contour.

2. The orthopedic shoe appliance of claim 1, wherein the pad is attached to an insole, a midsole, an outsole, or a sock.

3. The orthopedic shoe appliance of claim 2, wherein the pad is integrally formed with the insole, the midsole, the outsole, or the sock as a unitary piece.

4. The orthopedic shoe appliance of claim 1, wherein the pad is attached to a footwear.

5. The orthopedic shoe appliance of claim 4, wherein the pad is integrally formed with the footwear as a unitary piece.

6. The orthopedic shoe appliance of claim 1, wherein different areas of the pad have different heights and/or durometers.

7. A footwear, comprising:

an outsole;

a midsole or insole comprising:

a pad for providing support for midfoot arches, the second metatarsal, and the third metatarsal of a foot, wherein the pad comprises a first portion configured to provide support to the midfoot arches, and a second portion that extends distally from a region corresponding to proximal ends of the second and third metatarsals to form an elongate extension that supports the second and third metatarsals and such that the pad is configured to not fully support proximal ends of any of the first metatarsal, the fourth metatarsal, and the fifth metatarsal, wherein the first portion comprises a medial raised contour configured to be disposed under and support a medial arch and a lateral raised contour configured to be disposed under and support a lateral longitudinal arch and entire calcaneal-cuboid joint, such that the medial raised contour is higher than the lateral raised contour, wherein a width of the second portion is smaller than a width of the first portion, and wherein the distal end is narrower than a proximal end of the orthopedic shoe appliance, and the second portion, moving away from the distal end, widens generally continuously to reach the lateral raised contour.

8. The footwear of claim 7, wherein different areas of the pad have different heights and/or durometers.

9. The footwear of claim 7, wherein the outsole is wider than the midsole or insole in regions corresponding to the medial raised contour and the lateral raised contour.

10. The footwear of claim 7, wherein the outsole has a peak height in regions corresponding to the medial raised contour and the lateral raised contour.

11. The footwear of claim 10, wherein the peak height extends as high as the midsole or insole.

12. The footwear of claim 7, wherein the medial raised contour and the lateral raised contour extend to the outermost bounds of the midsole or insole.

13. The footwear of claim 7, wherein the medial raised contour and the lateral raised contour extend to the outermost bounds of a foot facing surface.

14. A footwear, comprising:

a sole, the sole having a pad for providing support for midfoot arches, the second metatarsal, and the third metatarsal of a foot, wherein the pad comprises a first portion configured to provide support to the midfoot arches, and a second portion that extends distally from a region corresponding to proximal ends of the second and third metatarsals to form an elongate extension that supports the second and third metatarsals and such that the pad is configured to not fully support proximal ends of any of the first metatarsal, the fourth metatarsal, and the fifth metatarsal, wherein the first portion comprises a medial raised contour configured to be disposed under and support a medial arch and a lateral raised contour configured to be disposed under and support a lateral longitudinal arch and entire calcaneal-cuboid joint, such that the medial raised contour is higher than the lateral raised contour, wherein a width of the second portion is smaller than a width of the first portion, and wherein the distal end is narrower than a proximal end of the orthopedic shoe appliance, and the second portion, moving away from the distal end, widens generally continuously to reach the lateral raised contour.

15. The footwear of claim 14, wherein different areas of the pad have different heights and/or durometers.

16. The footwear of claim 14, wherein sole is at its widest in regions corresponding to the medial raised contour and the lateral raised contour.

* * * * *